US005445454A

United States Patent [19]

Barkhorn

[11] Patent Number: 5,445,454

[45] Date of Patent: Aug. 29, 1995

[54] TUBULAR BAG PACKAGING

[75] Inventor: Gerald Barkhorn, Bendorf, Germany

[73] Assignee: Lohmann GmbH & Co. KG, Neuwied, Germany

[21] Appl. No.: 122,434

[22] PCT Filed: Feb. 26, 1992

[86] PCT No.: PCT/EP92/00397

§ 371 Date: Oct. 21, 1993

§ 102(e) Date: Oct. 21, 1993

[87] PCT Pub. No.: WO92/16431

PCT Pub. Date: Oct. 1, 1992

[30] Foreign Application Priority Data

Mar. 23, 1991 [DE] Germany ..... 41 09 605.3

[51] Int. Cl.[6] ..... B65D 65/28

[52] U.S. Cl. ..... 383/207; 206/440

[58] Field of Search ..... 206/438, 440; 156/153, 156/244.18, 252; 383/200, 201, 204–209; 426/122; 428/35.2, 43, 138; 493/346

[56] References Cited

U.S. PATENT DOCUMENTS

| | | | |
|---|---|---|---|
| 3,083,876 | 4/1963 | Schneider et al. | 383/208 |
| 3,265,287 | 8/1966 | Hovland | 428/43 |
| 3,393,118 | 7/1968 | Ekstrom | 156/252 |
| 3,687,358 | 8/1972 | Wink et al. | 383/209 |
| 4,057,919 | 11/1977 | Gauch et al. | 428/43 |
| 4,293,068 | 10/1981 | Focke et al. | 383/209 |
| 5,110,677 | 5/1992 | Barmore et al. | 156/244.18 |

FOREIGN PATENT DOCUMENTS

| | | | |
|---|---|---|---|
| 0226835 | 7/1987 | European Pat. Off. | 383/200 |
| 2190684 | 2/1974 | France . | |
| 2858166 | 8/1985 | Germany . | |
| 3618765 | 12/1987 | Germany . | |
| 0153459 | 6/1989 | Japan | 383/209 |
| 4044977 | 2/1992 | Japan | 426/122 |
| 670436 | 6/1989 | Switzerland . | |
| 2169874 | 7/1986 | United Kingdom | 383/200 |

*Primary Examiner*—Jimmy G. Foster
*Attorney, Agent, or Firm*—Collard & Roe

[57] ABSTRACT

Tubular bag packaging, for medicinal supply articles such as bandages or rigid dressings, in particular, consisting of a tough film web made up of several layers in a composite structure whose opposite borders are glued or welded together along a longitudinal seam to form a tube enveloping the material to be packed and which is sealed at its ends by means of two parallel transverse seams and which exhibits at least one aid to opening, enabling it to be torn open quickly and completely in order to remove the contents, whereby at least one of the transverse seams (1,2) exhibits controllable, given weakening in the form of an incision (3), which only divides the transverse seam (1) and (2), respectively, in an outer part of its width, and that a line of weakening (4) running across the length of the packaging (10) is intended for the tear, during the course of which at least one layer (12) of the composite structure making up the film (14) is provided with aids to tearing (5) such as incisions, perforations or thermal brittleness and impression and at least the cover layer (11) is unweakened.

2 Claims, 1 Drawing Sheet

TUBULAR BAG PACKAGING

Figure 1:
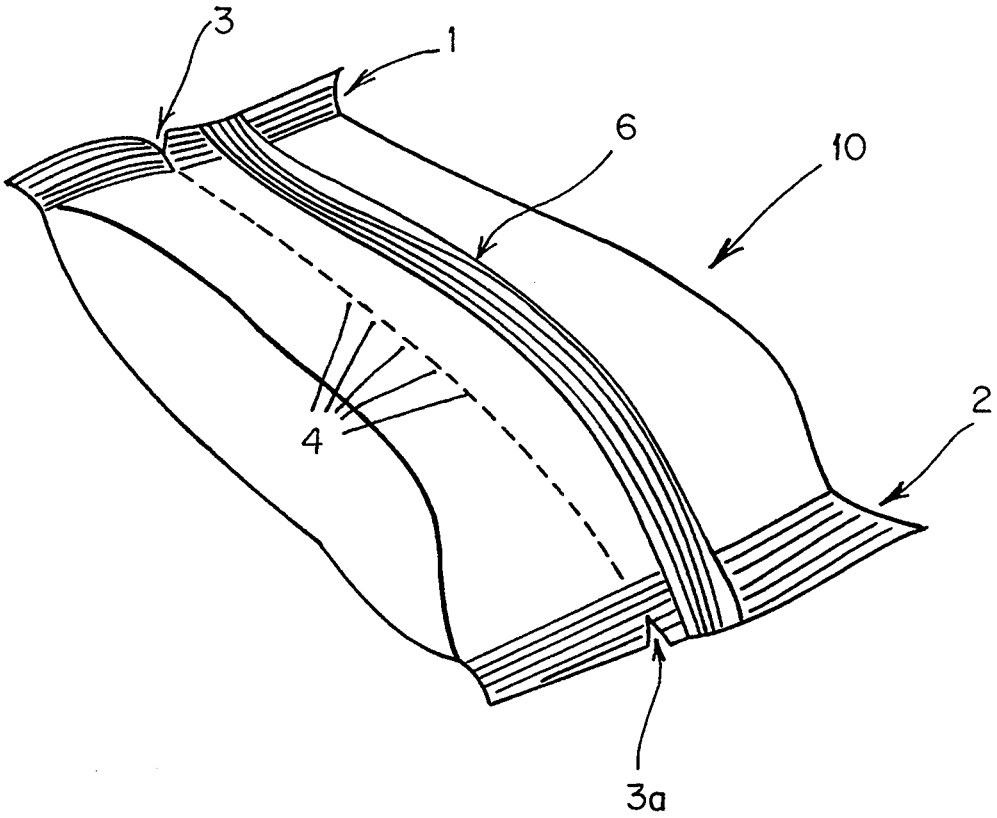

This application is a 371 of PCT/EP92/00397 filed Feb. 26, 1992.

The invention concerns a tubular bag packaging, for medicinal supply articles such as bandages or rigid dressings, in particular, consisting of a tough film web made up of several layers in a composite structure whose opposite borders are glued or welded together along a longitudinal seam to form a tube enveloping the material to be packed and which is sealed at its ends by means of two parallel transverse seams and which exhibits at least one aid to opening, enabling it to be torn open quickly and completely in order to remove the contents, whereby at least one of the transverse seams exhibits a controllable, Given weakening in the form of an incision, which divides the transverse seam only in one exterior part of its width, whereby a weakening line emanating from the area of this incision and running across the length of the packaging is provided for the tear.

A tubular bag packaging for pressure-sensitive material, for example layers of cheese slices, is known from FR-A-2190 684. A film web made of composite material of polyamide and polyethylene, the latter forming the inner layer and the polyamide the outer layer, serves as packaging material. When the borders of the film web are glued or welded together, a sealing seam running lengthwise is formed, whereas the ends are sealed tightly by means of transverse seams. An incision in the ends of the longitudinal seam in the vicinity of the inner angle of the fin of the seam serves as an aid to opening. The notch extends preferably into the area where the longitudinal and transverse seams intersect. A tear-off strip results at the end of the longitudinal and transverse seam and when this strip is pulled along the line of the longitudinal seam, it serves to open the packaging. Removing the contents of the packaging after the longitudinal seam has been torn off proves to be a disadvantage for the consumer, as the transverse seams are not opened at the same time, and the manipulation required to take out the contents is thus unnecessarily complicated. A line of weakening does not exist, either, in the direction of the intended tear at the base of the fin of the longitudinal seam, which is why only a film web which allows itself to be torn open easily can be used. This may be permissible for foodstuffs, which, as a result of the limited imperishability guarantee involved, only remain in the packaging for a short time, but it is not, however, acceptable as far as medicinal supply articles, such as bandages or rigid dressings, are concerned, which, as the case may be, remain in the packaging for a long time, are transported, stacked, restacked or distributed in it and require as packaging a particularly durable tubular bag packaging which, however, must be capable of being opened easily, quickly and completely the moment it is used.

A tubular bag packaging for material in the form of a bar or cake, such as, for instance, chocolate products, consisting of a sheet-like or paper-like covering possessing two transverse seams, running parallel to one another, formed by glueing or welding, and one longitudinal seam running vertically to these transverse seams, formed by means of face ends protruding as a tear-off strip and also joined firmly to one another by means of glueing or welding, and which can be opened by pulling the tear-off strip along this seam line, is known from DE-OS 36 18 765. In one face end of the tear-off strip in the vicinity of the transverse seam there is an aid to opening in the form of an opening which at least touches the; longitudinal seam and is open at the side. The opening concerned is an approximately semi-circular notch which has been punched out. A disadvantage of this tubular bag packaging is the low notch effect, which means that there is insufficient weakening in the area of intersection of the transverse and longitudinal seams, resulting in an aid to opening which is only of limited use when the packaging is torn open. The outcome is that several limits are set to the applicability of the proposed aid to opening and the latter can basically only be used for material in the form of a cake or bar and for packaging which can be torn easily.

From CH 670 436 A5 a packaging for individual articles is known which has a longitudinal fin seam and two transverse fin seams and is provided with an aid to opening. Said aid to opening consists of two reinforcement strips, which are located, at least in the area of one of the transverse fin seams, at a distance from each other, whereby at least one notch is located at the border of said transverse fin seam and within said distance. A single-layered web of material is used as packaging material, which means that transverse tears very easily form in the web of material when, upon opening, the portions of the transverse seam on both sides of the notch are torn outwardly; the contents is then released only incomplete or not at all. The purpose of the reinforcement strips, e.g. bands from polyester or a layer of hot-melt material, is to prevent that the package is opened along its entire length without a transverse tear occurring. The aid to opening is thus not realized by a weakening in the packaging material but, on the contrary, by reinforcement strips next to the imagined, unweakened tear line.

From DE 28 58 166 C2 a cuboid interior envelope for cigarettes, made from thin packaging material, for example tin foil or the like, is known. With this envelope the packaging material is, in the area of a tearing line, locally covered with a covering layer of tearable glue material, whereby following each serrating incision there is an additional incision running diagonally and in the opposite direction to the direction of tear. However, this packaging technique has been developed especially for cigarette packages and is totally unsuitable for a tubular bag packaging for medicinal supply articles, due to the strain to be expected when carrying sanitary material in sanitary bags, rucksacks, sanitary kits for cars and the like. Apart from the fact that there is no covering layer provided outside the actual tearing lines, environmental influences and conditions during transport would conglutinate the glue seams and destroy them.

The present invention provides which overcomes the aforementioned difficulties and technical limits of the prior art, which is particularly suitable for very durable packaging of medicinal supply articles, such as bandages or rigid dressings, and which, moreover, makes it possible to tear open the tubular bag packaging in a controlled manner, lengthwise, from transverse seam to transverse seam, thus enabling the packaging to be opened and the goods to be packed to be made accessible quickly and completely, and which can be produced using conventional mechanical facilities for packaging and sealing, at high packaging speeds, as well.

This task is successfully solved, in the case of a tubular bag packaging of the kind mentioned at the beginning, by the present invention. This form results in a line of weakening running across the length of the packaging between the incisions in the transverse seams, along which it is possible to tear open the tubular bag approximately parallel to the longitudinal seam without any problems. The line of weakening forms, so to speak, a predetermined breaking line, along which tearing can be controlled systematically, in a figurative sense, as in the case of a zip-fastener, and this despite the use of a tough, multilayered composite construction which exhibits a comparatively high resistance to tearing. The tubular bag is divided roughly into two halves in a plane of symmetry running lengthwise by the complete longitudinal tear. These two halves can then be folded down towards the side, from the tear outwards, so that the contents, for example a bandage, are accessible optimally, without delay. The provision of incisions on the transverse seams means that the procedure of tearing open the tubular bag is solved in an optimal manner ergonomically, because these transverse seams, which are corrugated in the direction in which they run, across the packaging, mean that access by hand is rendered very easy indeed. As a result the packaging can be opened carefully and completely, without goods to be packed which are sensitive being crushed or damaged.

Use can be made, as the case may be, of the fact that on both the upper side and the lower side of the tubular bag, respectively, emanating from the incisions, there is a line of weakening intended to be used for tearing.

Further useful embodiments of the object of the invention are also provided.

A practical process for the production of a film web with a composite construction comprising three layers, the middle layer being formed with a line of weakening exhibiting aids to tearing, is distinguished by the fact that a perforation or intermittent incisions or thermal brittleness are worked into the middle layer along a given line of weakening during or subsequent to its production and that after that the middle layer prepared in this manner is laminated on its upper side to the cover layer and on its lower side to the sealing layer.

A film web produced according to this process is characterised in that it is used to manufacture the tubular bag packaging according to the invention.

Figure 2:
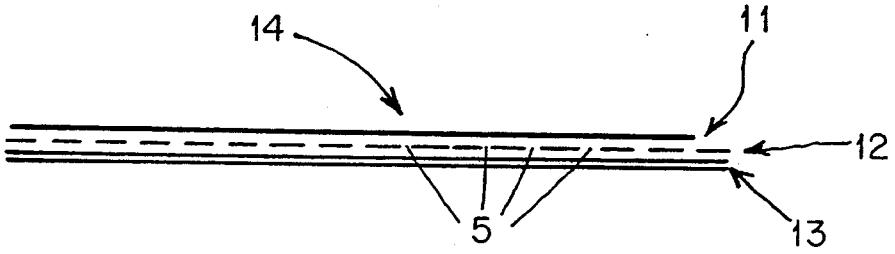

The object of the invention is shown in schematic drawings in a preferred embodiment, further advantageous details of the invention being taken from the elucidation of the drawings. The drawings show in detail:

FIG. 1: An outline of a tubular bag packaging, in perspective, with wedge-shaped incisions in the transverse seams and a line of weakening running between them exhibiting aids to tearing;

FIG. 2: The multilayered construction of a film web, with the pre-weakened middle layer enclosing the packaging, in section.

In FIG. 1 the tubular bag packaging 10 is shown, which is particularly suitable for the long-term, safe as well as sterile storage of sensitive, medicinal supply articles, such as bandages or rigid dressings. It consists of an extremely tough film web (FIG. 2), highly resistant to tearing, made up of several layers in a composite construction, whose opposite borders are glued or welded together along a longitudinal seam 6 to form a tube enveloping the material to be packed, and which is sealed at its ends by means of two parallel seams 1,2.

According to the invention, at least one of the transverse seams 1, preferably, however, each of the two transverse seams 1,2, exhibits controllable, given weakeaning in the form of a wedge-shaped incision 3, 3*a*. Each incision is constructed in such a manner that it divides the transverse seam 1 or 2, respectively, only in an outer part of its width, without endangering the hermetic seal of the tubular bag packaging, but far enough, however, to guarantee an effective aid to opening by means of notch effect. A line of weakening 4, for tearing, emanates from the area of these incisions 3, 3*a* and runs over the length of the packaging 10. According to the invention, this is formed in such a manner that during its course at least one layer 12 (FIG. 2) of the composite construction making up the film web 14 exhibits aids to tearing 5 such as incisions, perforations or thermal brittleness or impression, respectively. At the same time, the cover layer 11, at least, is unweakened.

The layer 12 exhibiting the highest resistance is preferably formed with aids to tearing 5.

In the embodiment shown, the multilayered composite construction of the film web 14 consists of a cover layer 11, preferably of PE (polyethylene), as well as a particularly tough middle layer 12, determining the strength, preferably of polyamide, and an inner layer 13 of a sealing material, preferably of one-sided drawn LDPE, the middle layer 12 being formed with aids to tearing 5. These can, as has been said, consist of a perforation or a series of small cuts similar to a zip-fastener or a thermically embrittled line of weakening or of a weakening impression. In addition one can make use of the provision that the middle layer 12 is formed in one, first direction with a comparatively high resistance to tearing and in a second direction, orientated crosswise to the former, with a comparatively low ultimate tensile strength, and that this middle layer 12 is arranged on the packaging with such an orientation vis-a-vis its inner structure that the direction of the low ultimate tensile strength runs lengthwise in the packaging 10, i.e. in the direction of the line of weakening 4.

According to the invention, only one of the two transverse Seams 1 or 2 need be supplied with an incision 3 or 3*a*. It proves to be extremely expedient, however, for both transverse seams to exhibit an incision 3, 3*a* and for the line of weakening 4 to run in the line connecting the two incisions 3, 3*a*, as shown in FIG. 1.

A non-problematic manufacture of the multilayered film, in whose composite construction the two outer layers 11 and 13 are formed unweakened, the middle layer 12, which is not visible from the outside, being formed, on the other hand, with a line of weakening, is produced advantageously and economically by working a perforation or an intermittent series of incisions or a line of thermal brittleness or a weakening impression into the middle layer 12, during or after its production, using known mechanical equipment, and then laminating the middle layer 12 prepared in this manner with the cover layer 11 and the sealing layer 13. And, finally, the film web produced according to this process is characterised in that it is used for the production of the tubular bag packaging 10 produced according to the invention.

It is, furthermore, advantageous that the tubular bag packaging can be produced according to the invention, without additional equipment, on any of the tubular bag forming, filling and sealing machines whose design is suitable, both economically and at a high working speed.

The invention thus provides an optimal solution to the task posed at the beginning.

List of the Reference Marks

1. Transverse Seam
2. Transverse Seam
3. Incision
4. Line of Weakening
5. Aid to Tearing
6. Longitudinal Seam
10. Packaging
11. Cover Layer
12. Middle Layer
13. Sealing Layer
14. Film Web

I claim:

1. A tubular bag package for medicinal supply articles comprising:

a film web for forming a package having a first longitudinal border, a second spaced longitudinal border, a first transverse border, a second spaced transverse border, and a composite construction including:

(i) a cover layer made of polyethylene, (ii) a middle layer made of polyamide, (iii) an inner layer made of a sealing material comprising one sided drawn LPDE;

whereby said middle layer has a tensile strength greater than said cover and inner layers;

a longitudinal seam formed by bonding said first and second longitudinal borders together to create a tube for enveloping the medicinal supply articles;

a first transverse seam formed by sealing said first transverse border together when said tube is formed from said film web;

a second transverse seam formed by sealing said second transverse border together when said tube is formed from said film web, said second seam being in spaced parallel relation with said first transverse seam;

at least one incision disposed in one of said transverse seams, said incision providing a controllable weakening in said transverse seam to aid in opening the tubular bag; and a tearing aid comprising a weakening line disposed in said middle layer and extending across said package parallel to said longitudinal seam from said at least one incision to the opposite transverse seam, said weakening line comprising one of intermittent incisions, perforations, thermal brittleness and an impression, wherein at least said cover layer is imperforate.

2. The tubular package of claim 1, wherein said middle layer has (i) a high ultimate tensile strength in a direction parallel to said transverse seams, and (ii) a low ultimate tensile strength in a direction perpendicular to said transverse seams.

* * * * *